United States Patent [19]

Monari

[11] Patent Number: 4,473,982

[45] Date of Patent: Oct. 2, 1984

[54] DEVICE FOR LAYING AND STRETCHING WATERPROOF COVERING SHEETS

[76] Inventor: Flaminio Monari, Via Gargantino 2, Mezzomerico, Novara, Italy

[21] Appl. No.: 352,580

[22] Filed: Feb. 26, 1982

[30] Foreign Application Priority Data

Feb. 27, 1981 [IT] Italy ..... 20941/81[U]

[51] Int. Cl.[3] ..... E04B 1/00

[52] U.S. Cl. ..... 52/222; 52/710; 160/395

[58] Field of Search ..... 52/222, 273, 710, 698, 52/63; 160/378, 380, 392, 395

[56] References Cited

U.S. PATENT DOCUMENTS

| | | | |
|---|---|---|---|
| 1,075,500 | 10/1913 | Schmits | 160/378 |
| 1,184,265 | 5/1916 | Schmits | 160/380 |
| 1,895,309 | 1/1933 | Boomershine | 160/378 X |
| 3,611,649 | 10/1971 | Muller et al. | 52/222 X |
| 4,040,228 | 8/1977 | Skubic | 52/710 |
| 4,129,007 | 12/1978 | Rausch | 52/698 X |
| 4,189,880 | 2/1980 | Ballin | 160/380 X |
| 4,233,790 | 11/1980 | Meadows | 52/222 |
| 4,316,308 | 2/1982 | Chatelain | 160/392 X |

FOREIGN PATENT DOCUMENTS

| | | | |
|---|---|---|---|
| 2916814 | 6/1980 | Fed. Rep. of Germany | 52/222 |

*Primary Examiner*—Carl D. Friedman

*Attorney, Agent, or Firm*—Fleit, Jacobson, Cohn & Price

[57] ABSTRACT

Device for laying and stretching covering sheets over surfaces to be protected, the device comprising a first channel element, having a bottom and lateral walls, a second channel element having a bottom and lateral walls, smaller in depth than those of the former; first fastening means for securing one of said channel elements with its bottom facing towards the surface to be covered. Second fastening means being also provided in order to secure the other of said channel elements in position over the first one and with its lateral edges facing towards the bottom of the first channel element securing and tensioning the covering sheets interposed between the aforementioned channel elements.

6 Claims, 3 Drawing Figures

DEVICE FOR LAYING AND STRETCHING WATERPROOF COVERING SHEETS

BACKGROUND OF THE INVENTION

This invention concerns a device for laying and stretching sheets of covering, for example, waterproof sheets made of synthetic material, suitable for protecting the surfaces of hydraulic structures, and roofs of civil, industrial and similar buildings. As is known, in order to lay waterproof coverings on flat and similar surfaces, the covering sheet or sheets are normally secured, along one edge of the surface to be covered, for example, by means of gun-riveting; after which the sheets are stretched out by hand and then secured by means of traditional fasteners, such as screws, nails and the like. With anchoring and stretching systems of the mentioned type, the laying and stretching operation proves to be rather difficult, especially when the surfaces to be covered are extensive; furthermore, stretching the sheets by hand proves to be an operation which is both laborious and difficult to carry out within a comparatively short period of time.

The scope of this invention is to provide a device for laying and stretching covering sheets for protecting surfaces in general, which enables the operations of securing and stretching of the sheets themselves to be carried out automatically and with the greatest of ease. A further scope of this invention is to provide a device suitable for laying waterproof sheets on flat, sloping and/or slightly curved surfaces of any shape and size.

SUMMARY OF THE INVENTION

According to the invention, the device for laying and stretching covering sheets over surfaces to be protected, comprises: a first channel-shaped element having a bottom and lateral walls, a second channel-shaped element having a bottom and lateral walls smaller in depth than those of the first element; first fastening means for securing one of said channel elements with its bottom facing towards the surface to be covered, second fastening means being also provided for securing the other of said channel elements in position over the first one and with its lateral edges facing towards the bottom of the first element, securing and tensioning the covering sheets inserted between the aforementioned channel elements.

The channel elements may be of any appropriate shape and may have dimensions and lengths suitable for the work to be carried out; two embodiments of the device will be described hereunder, with reference to the examples of the accompanying drawings, in which:

DESCRIPTION OF THE INVENTION

Figure 1:
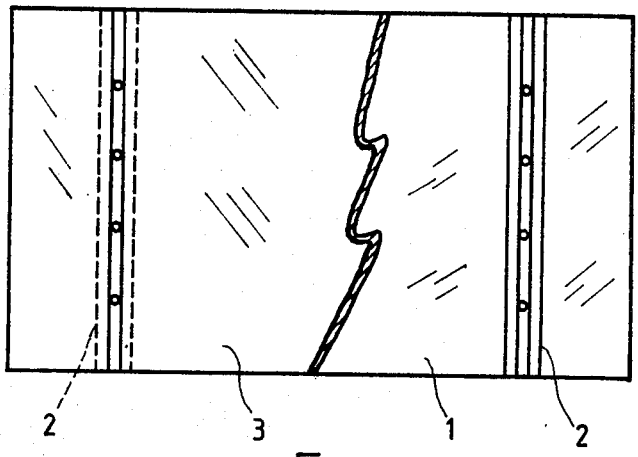
FIG. 1 shows a plan view of a generic surface covered with sheets of waterproof material, secured by means of the stretching device according to the invention.

FIG. 1 shows a generic surface 1, for example, a flat surface which must be protected with a covering consisting of one or more sheets of waterproof material (partially shown), which is stretched out and secured to the surface 1 by means of devices 2 according to this invention.

Figure 2:
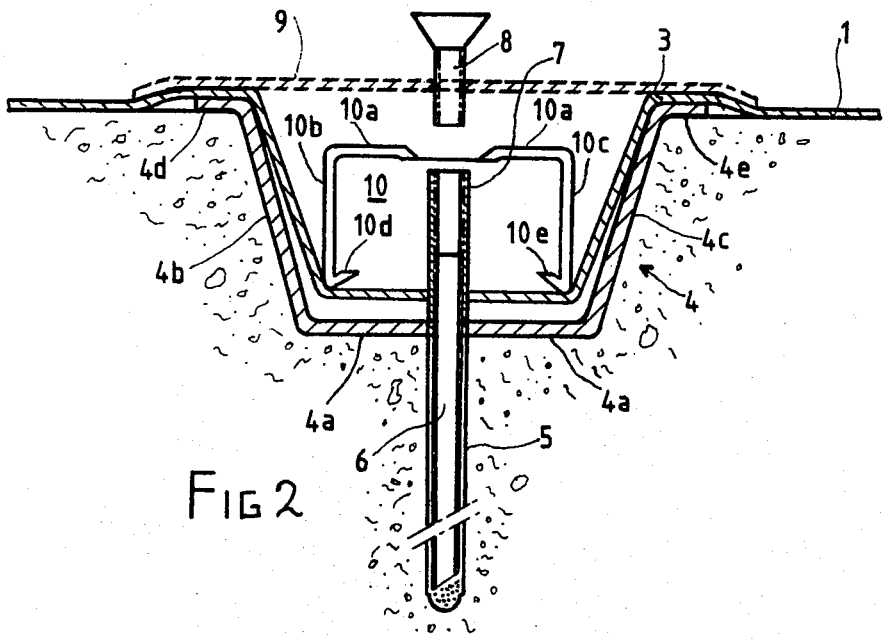
FIG. 2 shows an enlarged cross section of a first embodiment of the securing and stretching device.

As shown in the example in FIG. 2, each device 2 for stretching and securing the covering 3 comprises a first channel element 4 which is fitted into a channel seat made in the surface to be covered; the channel element 4 presents lateral walls with lengthwise edges facing upwards, coming to rest flush with the surface 1. In particular, in the example shown, the channel element 4 comprises a flat bottom **4*a* and lateral walls 4*b* and 4*c* sloping outwards, ending with its upper edges 4*d* and 4*e* bent outwards against the surface 1** to be covered.

The element 4 is secured to the surface 1 by means of a set of first fasteners comprising threaded pins 6 (one only shown in FIG. 2) anchored in a hole 5 in the surface 1, for example, by means of a chemical capsule containing a substance which hardens, or other equivalent means.

The anchoring pins 6 are arranged at regular distances along the element 4 and partially protrude through holes made in the bottom **4*a*; a sleeve 7 is screwed onto the upper protruding end of each threaded pin, thereby securing the channel element 4 to the surface 1**.

The device for laying and stretching waterproof coverings, also comprises a second channel element 10, placed over and upside down with respect to the first, having a bottom **10*a*, and lateral walls 10*b* and 10*c* ending with edges inwardly bent and facing towards the bottom 4*a* of the first channel-shaped element 4. As it can be seen from the cross-section in FIG. 2, the second channel shaped element 10** presents lateral walls smaller in height so as to allow a certain amount of movement between one element and the other.

The channel element 10 is secured in the desired position, after laying the waterproof covering 3, by means of screws 8 which pass through corresponding holes in the bottom **10*a* of the element 10 and which screw into the aforementioned sleeves 7. The screws 8 and the sleeves 7, besides constituting a means for securing the second channel element 10, also constitute a means for adjusting the tension of the waterproof covering 3 as explained further on. In fact, the covering 3 of waterproof material is laid on the surface 1 after having secured all the channel elements 4 and before arranging the channel elements 10 in position; the covering is thus interposed between the channel elements themselves, adhering to the opposing lengthwise edges 4*d*, 4*e*, 10*d*, 10*e* of the latter. The covering sheets 3 must obviously be provided with suitable holes for the screws of each sleeve 7** of the device, to pass through.

Once the waterproof covering 3 has been laid, in such a way as to enter or form a small loop inside the element 4, and after having secured said covering along at least one of its outer edges, the second element 10 is then placed in position over the first element 4, and the screws 8 are screwed into the sleeves 7. As the covering 3 is raised or detached from the bottom **4*a* of the channel element 4, by tightening the screws 8, it is possible to narrow the distance between the two elements 4 and 10 with a subsequent tensioning and securing of the waterproof covering 3. It is obvious that, by adopting elements with suitable dimensions in width and in depth, and by using an adequate number of securing screws 8**, it is possible to lay covering sheets of any size and thickness, even very large, extremely easily and securely.

After having carried out the fastening and final stretching of the covering 3, providing if necessary, for the seals in correspondence with the screws 8, the device is completed by means of a strip 9 of synthetic material constituting a butt-strap, which will then be welded and suitably secured along its edges, to the waterproof covering 3 below.

Figure 3:
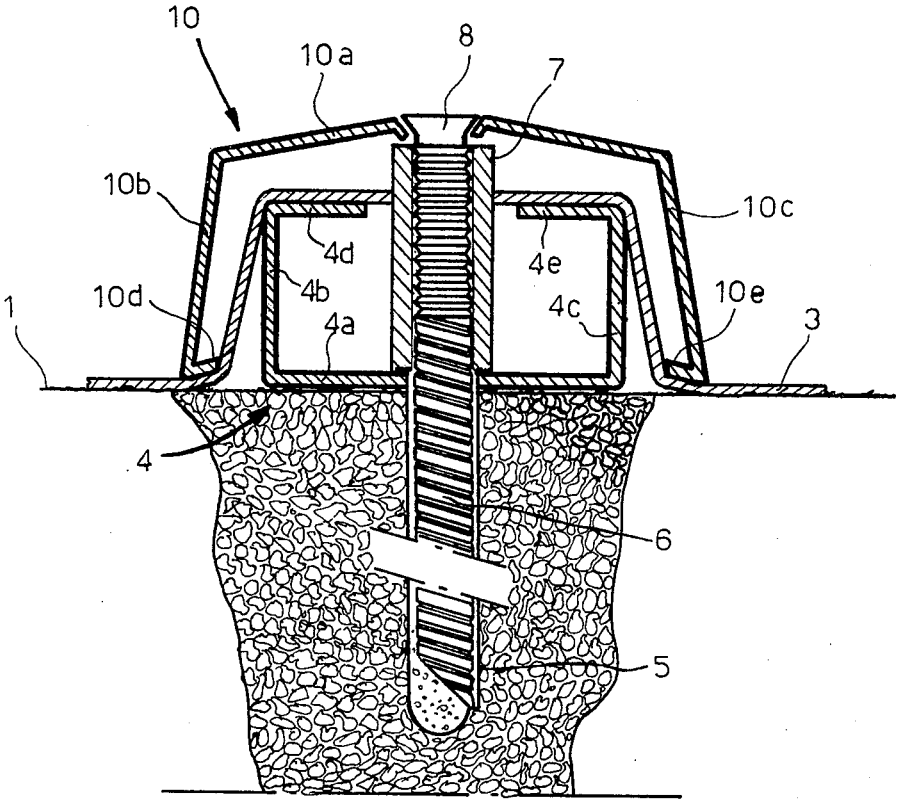
FIG. 3 shows a section similar to that of the previous FIG. 1 for a second arrangement and embodiment of the device.

In the example given in FIG. 2, the channel elements 4 and 10 of the entire device are completely embedded into the surface 1 to be protected, in such a way as not to protrude, this arrangement may be used by providing a suitable seat in the surface 1, during construction or when casing the surface itself. Whenever, on the contrary, the surface 1 is not provided with channel seats for housing the devices for laying and stretching the covering 3, or in other conditions, it is possible to make use of the device by inverting the disposition of the channel elements 4 and 10, as shown in FIG. 3, after having modified the bend in the lateral edges 4*d*, 4*e* and 10*d*, 10*e* of the above-mentioned channel elements. Consequently, the same numerical references have been used in FIG. 3, to indicate corresponding parts. It can be seen, from the aforementioned figure, that also in this case, one of the channel elements, in particular, the element indicated by reference 4, is secured with its bottom 4*a* resting directly upon the surface 1 to be protected, in such a way that the covering 3, in correspondence with each element 4, is held raised from the surface, arranging itself on the plane defined by the edges 10*d*, 10*e* of the element 10 itself. After having secured the elements 10 to the surface to be protected, and after having laid the waterproof covering 3, the channel-shaped elements 4 are placed over the other element, upside down, so that, by means of their lengthwise edges 4*d* and 4*e*, they push the covering 3 down against the surface 1, tensioning it and causing it to adhere perfectly to the surface itself.

It is understood that what has been described and shown with reference to the accompanying drawings, has been given merely in order to exemplify this invention, and that the shape of the channel elements, and also their means of fastening, may be varied and adapted according to the various requirements, without, however, deviating from the invention as claimed.

What is claimed is:

1. Device for laying and stretching covering sheets over surfaces to be protected, comprising: a first channel-shaped element, fitted into a pre-formed seat in the surface to be covered, having a flat bottom and sloping lateral walls ending with outwardly bent edges defining a bearing surface for covering sheets substantially coplanar to the aforementioned surface, a second channel-shaped element having a bottom and lateral walls smaller in depth than those of the first element and arranged within the first element; first fastening means for securing one of said channel shaped elements with its bottom facing towards the surface to be covered; second fastening means being also provided in order to secure the other one of said channel elements in position over the first one and with its lateral edges facing towards the bottom of the first element, securing and tensioning the covering sheets interposed between the aforementioned elements.

2. Device as claimed in claim 1, in which said second channel element is secured by its base, directly onto the surface to be covered, and in which said first channel element is placed over the second element, the latter presenting lateral walls with inwardly bent edges defining a bearing surface for the covering sheets, spaced apart from the surface to be covered.

3. Device as claimed in claim 1, in which said first fastening means comprise a threaded pin secured to the surface to be covered and an element for blocking the channel element, screwed onto the protruding end of said pin.

4. Device as claimed in claim 1, in which said second fastening means for securing and adjusting the position of the two channel elements, comprise a fastening element screwed into the sleeve of an anchoring pin secured to the surface to be covered, said sleeve being aligned with a corresponding aperture in the bottom of the aforementioned channel element.

5. Device as claimed in claim 1, in which a butt-strap is provided, in the form of a strip of waterproof material placed over the device and welded along its lateral edges, to the covering sheets themselves.

6. A stretching device for laying waterproofing covering sheets over a surface to be protected, comprising: first and second superimposed channel-shaped elements each comprising a bottom and lateral walls, one of said channel elements being fastened to and having shoulder portions to be positioned against a surface to be protected, the other one of said channel elements being movable relative to the former; fastening means for securing the said one channel element to the surface to be protected, and tensioning means acting on said other one of said channel elements for tensioning a covering sheet interprosed between said first and second channel-shaped elements, said fastening and said tensioning means comprising a fastening pin fixed to said surface and protruding through a hole in the bottom of said one channel element, and a fastening sleeve screwed onto the pin and against the bottom of said one element, the tension-ing means further comprising an adjustable tensioning, bolt element, said bolt element passing through a hole in the bottom of said other one channel element and being screwed into said fastening sleeve.

* * * * *